US005209375A

United States Patent [19]

Fuchs

[11] Patent Number: 5,209,375

[45] Date of Patent: May 11, 1993

[54] MEDIA DISPENSER WITH INDEXING CAP

[75] Inventor: Karl-Heinz Fuchs, Radolfzell, Fed. Rep. of Germany

[73] Assignee: Ing. Erich Pfeiffer GmbH & Co. KG, Fed. Rep. of Germany

[21] Appl. No.: 751,882

[22] Filed: Aug. 28, 1991

[30] Foreign Application Priority Data

Aug. 31, 1990 [DE] Fed. Rep. of Germany ..... 4027669

[51] Int. Cl.[5] ..... B67D 5/26

[52] U.S. Cl. ..... 222/38; 222/36

[58] Field of Search ..... 222/36, 38; 221/7; 235/94 R; 116/284, 309, 311

[56] References Cited

U.S. PATENT DOCUMENTS

| | | | |
|---|---|---|---|
| 2,767,680 | 10/1956 | Lermer | 116/121 |
| 3,678,884 | 7/1972 | Robbins | 116/121 |
| 3,796,348 | 3/1974 | Zipper | 222/38 |
| 4,162,746 | 7/1979 | Anderson et al. | 222/153 |
| 4,350,265 | 9/1982 | Griffiths et al. | 222/38 |
| 4,376,495 | 3/1983 | Spatz | 222/46 |
| 4,667,845 | 5/1987 | Frazier et al. | 221/5 |
| 4,753,189 | 6/1988 | Mastman et al. | 116/311 X |
| 4,817,822 | 4/1989 | Rand et al. | 222/38 |
| 4,961,508 | 10/1990 | Weimer et al. | 222/181 |

FOREIGN PATENT DOCUMENTS

| | | | |
|---|---|---|---|
| 1899374 | 1/1964 | Fed. Rep. of Germany . | |
| 1227198 | 10/1966 | Fed. Rep. of Germany . | |
| 1278077 | 9/1968 | Fed. Rep. of Germany . | |
| 6603758 | 7/1969 | Fed. Rep. of Germany . | |
| 2740298 | 3/1978 | Fed. Rep. of Germany . | |
| 3335301 | 1/1985 | Fed. Rep. of Germany . | |
| 8590143 | 5/1987 | Fed. Rep. of Germany . | |
| 2411140 | 7/1979 | France . | |
| 459875 | 9/1968 | Switzerland . | |
| 998765 | 7/1965 | United Kingdom . | |
| 1317315 | 5/1973 | United Kingdom | 222/38 |

*Primary Examiner*—Andres Kashnikow
*Assistant Examiner*—Lesley D. Morris
*Attorney, Agent, or Firm*—Quarles & Brady

[57] ABSTRACT

A manually operable discharge apparatus (1) has a counting or determination device (20) to be mounted as a separate component on the discharge unit (2) and which is operated stepwise by the removal or fitting of a protective cap (23). Thus, existing discharge apparatuses (1) can be easily equipped with randomiy operating determination devices (20).

22 Claims, 2 Drawing Sheets

MEDIA DISPENSER WITH INDEXING CAP

FIELD OF THE INVENTION

The invention relates to a discharge apparatus for media of a random type or for flowable media, in which in particular there is one or more manual or similar discharge actuation or operation.

BACKGROUND OF THE INVENTION

Such discharge apparatuses can have one or more determination or acquisition devices for determining or acquiring relevant data, e.g. for storing and indicating a first use, the number of discharge cycles performed, etc. To this end the determination device is controlled by means of one or more actuators, which is influenced e.g. manually or in some other way.

In known discharge apparatuses the determination is strictly and uninfluenceably bound with the discharge actuation, so that e.g. for cosmetic or pharmaceutical uses a determination only of the fact of the actual use independently of the number of discharge cycles performed is not possible.

SUMMARY OF THE INVENTION

An object of the invention is to provide a discharge apparatus or a determination device for the latter, which avoids the disadvantages of known constructions and in which a random determination is permitted.

This object is achieved by an actuator for the determination device, which can be operated manually or in some other way independently of the discharge actuation and therefore allows a data storage independently of the discharge operation or actuation. For example, the number of uses with or without direct indication can be determined. It is also possible to indicate the next following use time independently of the number of discharge actuations during the preceding use.

The actuator can at least partly be axially and/or radially removable from the discharge apparatus, e.g. tiltable or completely separable from said discharge apparatus in the manner of an actuating key. In both cases it can be constructed so that in the inserted state, in the manner of a catch, an actuation of the discharge apparatus is rendered impossible.

If a certain force is necessary for actuating the determination device at the end of a use of the medium, the actuator can be constructed in such a way that without it being transferred into an actuating position use of the discharge apparatus is at least made difficult. This can e.g. be achieved in that the actuator is constructed as a fastener, protective cap, etc. at least for a part of the discharge apparatus, namely for at least one of the components formed by the discharge actuator, the determination device and a discharge opening. On fitting this fastener the determination device is consequently automatically operated.

Particularly if the adjusting movement of the discharge apparatus member to be operated or indexed with the actuator is a rotary movement roughly coaxial to the actuator, the arrangement is appropriately such that the actuator is prevented from twisting. The removable actuator during an actuating movement is firstly brought into plug-in engagement with a twisting preventing means and then into plug-in engagement with a movement control for the movable member. The latter can be a determination member, which either has a marking, such as an indicating window for the movement along a scale and/or such a scale for the movement along a marking or the like. The actuators, determination devices, retaining guides, adjusting members, indicating devices, operating catches, bodies, structures, etc. according to the subclaims can in each case be separately provided or the corresponding features can be combined into a single arrangement. Therefore the discharge apparatus can have two or more forcibly control-connected and/or independently operable determination devices.

The inventive determination device is suitable for discharge apparatuses, which are operated with at least one pump, e.g. a thrust piston pump, with a squeezable storage vessel, with a pipette, with a dropper, etc. It is also suitable for those discharge apparatuses which have at least two separately, jointly and/or independently operable individual discharge apparatuses, which optionally deliver from separate storage vessels.

Independently of the described construction the problem of the invention can also be solved in that at least one determination device can be fitted substantially independently of a discharging means, such as a discharge pump, or can be formed by an assembly or component separate from such a discharging means, which is e.g. fixed directly onto a storage vessel to be provided with the discharging means or by means of a separate flange to a fastening member on the storage vessel, to which is also fixed the discharging means. In a very simple construction a body or structure of the determination device is fitted with a resilient snap or notch connection or a clamping plug-in connection. Thus, the determination device can be fitted randomly to storage vessels without influencing the construction of the discharging means.

For solving the problem a case for the discharge apparatus is also proposed, which is appropriately constructed for the substantially completely encapsulated reception both of a storage vessel and the discharging means fitted thereto. If a determination device is to be provided, it can be constructionally directly combined with the case without it being necessary to in any way modify the discharge unit comprising the storage vessel and discharging means. The storage vessel is appropriately made from glass.

As a result of the inventive construction each discharge apparatus can be randomly adapted to the particular use in that it can be provided with a randomly operating determination device. Therefore the discharge apparatus can e.g. be combined with such a determination device corresponding to the medically prescribed, individual use mode of a medicine.

BRIEF DESCRIPTION OF THE DRAWINGS

These and further features can be gathered from the claims, description and drawings and the individual features, both singly and in the form of subcombinations, can be realized in an embodiment of the invention and in other fields and can represent advantageous, independently protectable constructions for which protection is hereby claimed. Embodiments of the invention are described hereinafter relative to the drawings, wherein show:

DETAILED DESCRIPTION OF THE PREFERRED EMBODIMENTS

Figure 1:
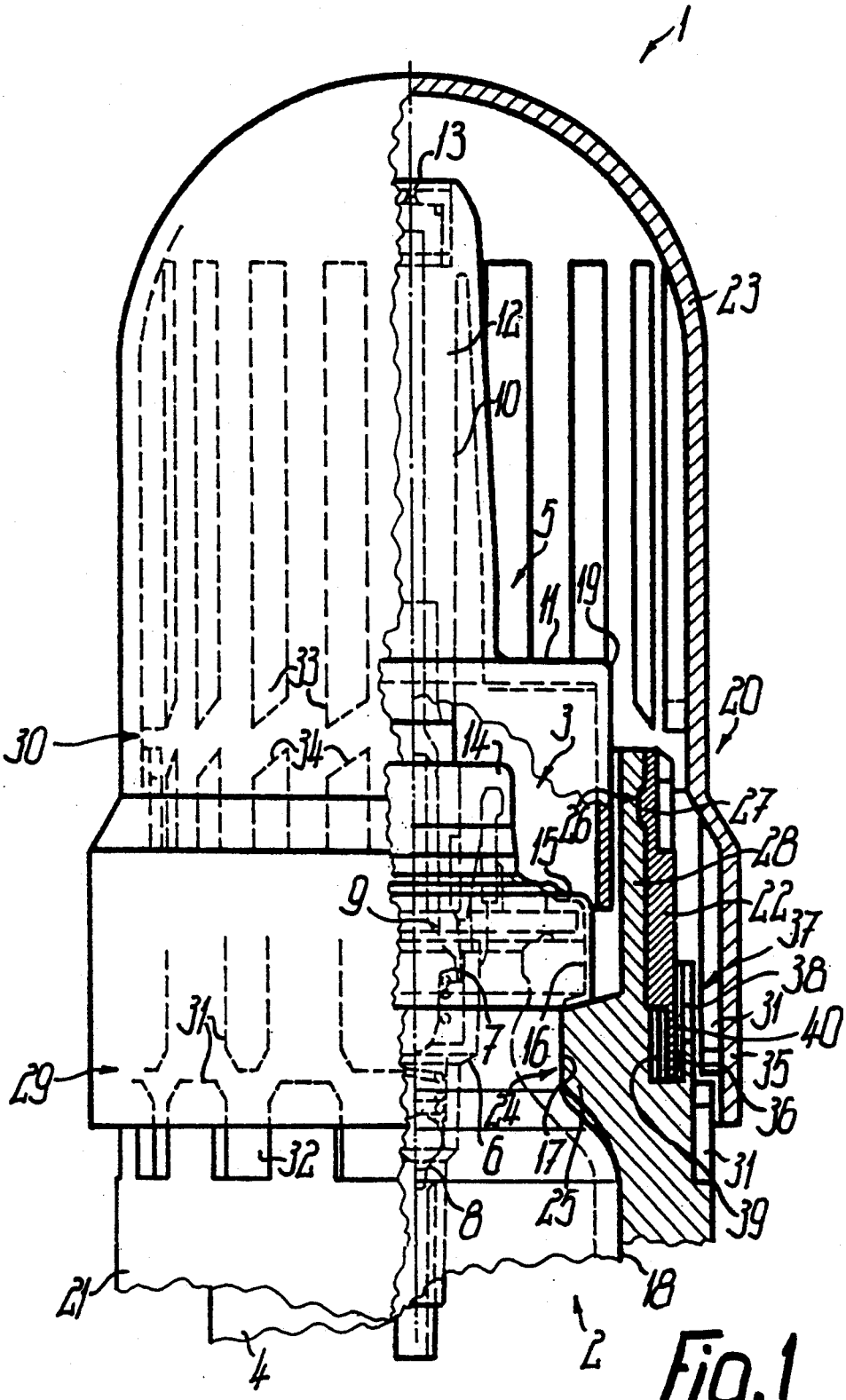
FIG. 1 An inventive discharge apparatus partly in axial section.

The discharge apparatus 1 has a discharge unit 2 constructed as a closed assembly having a discharging means 3 and a storage vessel 4, which are manually operated or actuated by a discharge actuating means 5. The piston unit 7 of a pump 6 largely engaging in the storage vessel 4 is operated and its pump chamber has a valve-controlled inlet 8 and a valve-controlled outlet 9. For operation purposes a piston or operating rod 10 is provided, which is connected to a delivery handle 11 in the form of a pressure surface surrounding it and is arranged by means of a plug-in connection on the piston rod of the piston unit 7. The operating rod 10 is traversed by an outlet channel connected to the outlet 9, is surrounded by a discharge connecting piece 12 constructed in one piece therewith and located roughly in the pump axis and has in the vicinity of its end face the discharge nozzle or discharge opening 13 of the discharge unit 2 leading into the open. The cylinder casing forms with a cylinder cover a body 14 with which the discharging means 3 can be fixed by a fixing or fastening member 15, e.g. a crimp ring engaging round a cap-like vessel flange 16, to the vessel neck 17. Between the vessel flange 16 and the vessel bulge 18 the vessel neck 17 forms on the outer circumference a circular groove, which can be bounded on one side by the fastening or fixing member 15. The part of the body projecting from the storage vessel 4 and the fastening member 15 are engaged over by a cap 19, whose face forms the delivery handle 11.

For counting the frequency of opening or exposing of the discharge actuating means 5 secured by a protective cap a determination or memory device 20 is provided, which forms a subassembly to be fitted independently of the discharge unit and which is fixed to the storage vessel 4 upstream or downstream of the discharge unit and which can be substantially contact-free with respect to said unit 2. The determination device 20 has a sleeve-like body 21, which engages in centred manner on the outer circumference of the storage vessel 4 and partly also surrounds the body 14, the fastening member 15 and/or the cap 19. On its outer circumference the body 21 carries a sleeve or ring-like determination member 22, which is movable and in particular rotatable about the pump axis and which with the actuator 23 formed by the protective cap on each occasion advances or indexes by one step when the actuator 23 is mounted for covering the discharge actuating means 5, the discharge connecting piece 12, the discharge opening 13, the determination member 22 and/or further components. The body 21 is fixed by a snap connection 24 by axial engagement on the vessel neck 17 and for this purpose has on its inner circumference a resiliently expandable torus 25, which engages in substantially axial clearance-free and pretensioned manner in the circular groove of the neck 17. The cap 19 is to be fixed by engagement to the operating rod 10 following the fitting of the body 21 on the piston rod, so that during fitting the torus 25 can slide away over the fastening member 15.

The determination member 22 is arranged with a snap connection 26 in axially secured manner on the body 21 and for this purpose has on the inner circumference a torus 27, which engages in a circular groove on the outer circumference of a sleeve-like jacket portion 28, which forms the end portion of the body 21 connected to the torus 25 and surrounds on the outer circumference the cap 19.

The actuator 23 can have angular or substantially circular base cross-sections. Appropriately after the start of the self-centring engagement on the body 21, said actuator 23 is prevented from rotating about its central axis by a then engaging retaining guide 29. The actuator 23 appropriately only comes into engagement with the subassembly of the determination device 20 located on the discharge unit 2 and remains substantially contact-free with respect to the latter.

After the retaining guide 29 has come into engagement, the actuator 23 engages by means of a servodrive 30 with the determination member 22, so that the latter rotates by one of several operating steps. The retaining guide 29 has on the inner circumference of the actuator 23 and at a limited distance from its cap opening circumferentially distributed locking cams 31 formed by axial webs and which have at their ends sloping entry faces. Corresponding locking cams 31 are also provided on the outer circumference of the body 21 roughly in the axial area of the torus 25. Between laterally adjacent locking cams 31 are formed roughly axial locking grooves 32, which are widened in funnel-shaped manner towards their engagement ends. On engaging the actuator 23, the locking cams 31 of one component enter the locking grooves 32 of the other, so that the body 21 and actuator 23 are prevented from rotating against one another.

At a greater distance from the cap opening the servodrive 30 is also provided on the inner circumference of the jacket of the actuator 23 with uniformly circumferentially distributed adjusting cams 33 in the form of roughly axial web projections. Corresponding countercams 34 are provided on the outer circumference and only on one end portion of the determination member 22. The adjusting cams 33 and countercams 34 have complimentary, inclined end faces with which they strike one another when the actuator 23 is prevented from rotating and during its further engaging movement. Thus, to the determination member 22 is transferred a rotary movement corresponding to the width of the control cams until the latter are inserted in grooves between the countercams 34, the latter being introduced into corresponding grooves between the adjusting cams 33. In the end position the actuator 23 can be stop-limited e.g. by the engagement of the cap bottom on the end face of the discharge connecting piece 12. So that the locking cams 31 cannot engage with the countercams 34, the locking cams 31 are provided on a widened end portion 35 of the actuator 23. The countercams 34 are located roughly in the same axial area as the snap connection 26 to facilitate easy action.

The rear end of the determination member 22 which is more remote from the servodrive 30, engages in a frontal circular groove in that on the outer circumference it is surrounded by a thin-walled cover jacket 36 of the body 21. In this area is provided an indicator 37 controlled by the determintion device 20 and which is formed by an indicating window 38 in the cover jacket 36 and a scale 40 on the outer circumference of the determination member 22. In each case one of the scale symbols is free in the indicating window 38, whilst the other is rendered invisible by the cover jacket 36. As a result of the described construction the actuator 23 can be mounted with the same effect in numerous different relative rotary positions. In the mounted state it also covers with its end portion 35 the indicator 37 on the outer circumference. If the reading is only to be identifiable with the protective cap removed, then it is made opaque in the corresponding area. However, at least in this area it can also be made from a transparent material.

So that the determination member 22 is not secured in the set position by friction only, a locking means 39 is provided, which e.g. has in the vicinity of the rear end on the circumference of the determination member 22 and on an outer circumferential surface of the body 21 interengaging locking teeth. If said locking teeth are so arranged with respect to their tooth pitch or distribution that they have not completely interengaged at the end of an indexing process by the servodrive 30 and instead engage on one another in pretensioned manner with sides or profiles and whilst exerting a rotary force, then on removing the actuator 23 and releasing the servodrive 30, under said force the determination member 22 will be rotated on by a small amount in the rotation direction corresponding to the indexing movement, so that during the following mounting or engagement of the actuator 23 the adjusting cams 33 and countercams 34 reliably come into rotary engagement again.

Figure 2:
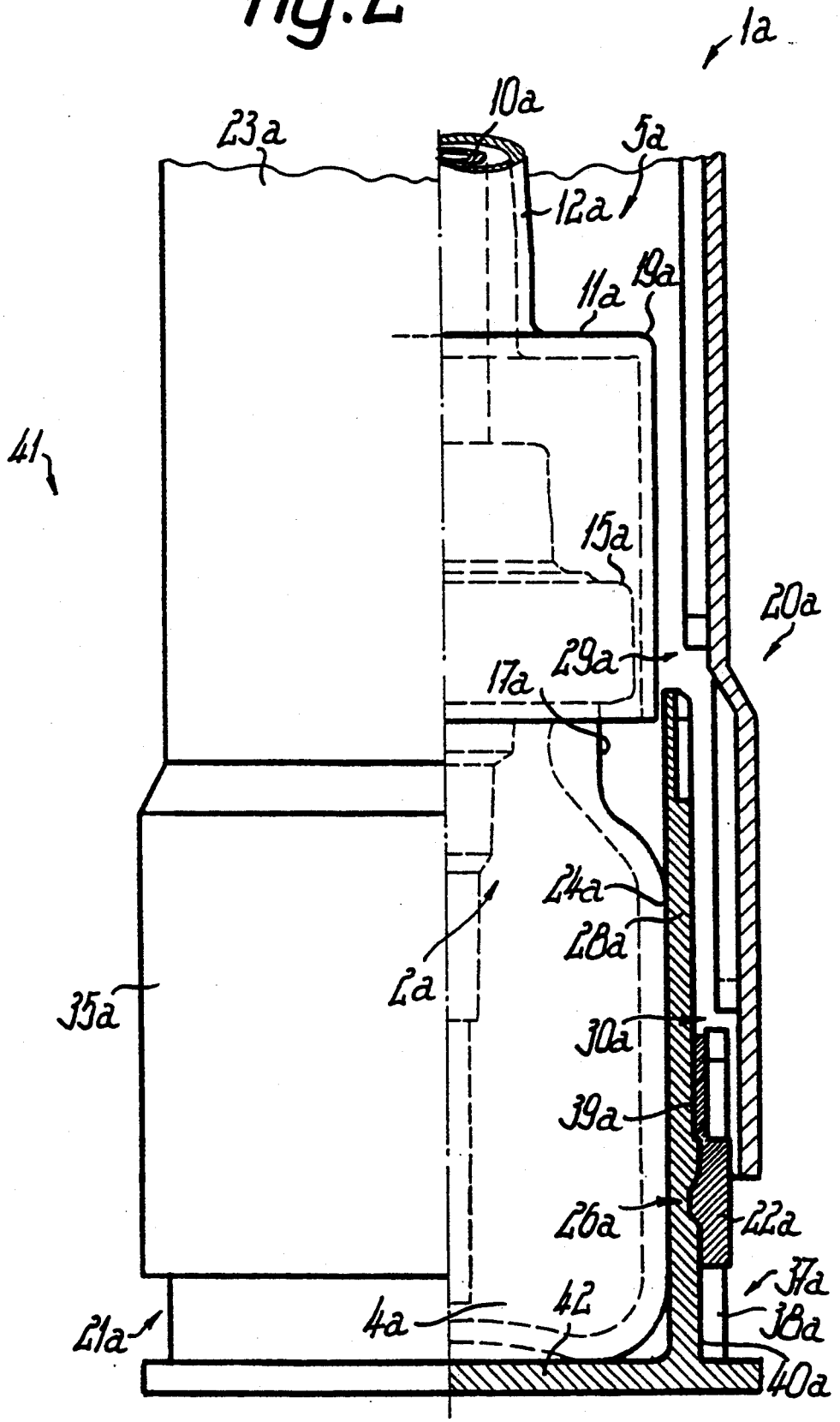
FIG. 2 Another embodiment in a representation corresponding to FIG. 1.

To the left of FIG. 2 is shown the end position of the actuator 23a and to the right a preceding position corresponding to that according to FIG. 1. In FIG. 2 corresponding components have the same reference numerals as in FIG. 1, but followed by the letter a, so that all description parts apply correspondingly to all the embodiments.

According to FIG. 2 for the completely encapsulated reception of the discharge unit 2 is provided a case 41 formed by a basic casing and a cover. Appropriately the basic casing is formed by the body 21a and the cover by the actuator 23a of the determination device 22a. The discharge unit 2a is inserted in the body 21a until the storage vessel 4a strikes against the bottom 42 of the body 21a and is only secured on its inner circumference by a pretensioned frictional connection 24a. The jacket 28a which has a substantially constant thickness over its length surrounds the cap 19a over part of its length even if the discharge actuating means 5a is in the starting position, so that the vessel neck 17a is covered by the jacket 20a and the fastening member 15a by the cap 19a.

The determination member 22a is positioned completely freely on the outer circumference of the jacket 28a and extends to the collar-like bottom 42 projecting over the outer circumference. In this case the scale 40a is provided on the outer circumference of the jacket 28a and the indicating window 38a in the rear or lower end of the determination member 22a, in such a way that is still exposed if the actuator 23a is mounted in the end position. In this embodiment the servodrive 30a is located in the vicinity of the widened end portion 35a and closer to the cap opening than the retaining guide 29a, which has at the open end of the jacket 20a locking cams and locking grooves. The determination member 22a only extends over part of the length of the jacket 28a and is spaced behind its front or open end.

I claim:

1. A dispenser for media having a storage vessel for the media and an outlet, said dispenser comprising:

at least one discharge actuating means for actuating a discharge of the media from the storage vessel to the outlet and at least one memory device for registering exposure of said discharge actuating means, said memory device being controllable by means of at least one memory actuator, wherein said at least one memory actuator for said at least one memory device is provided separately from said at least one discharge actuating means, whereby said memory actuation can be actuated independently of manipulation of said discharge actuating means.

2. The dispenser according to claim 1, wherein said at least one memory actuator removably mounts on said at least one memory device.

3. The dispenser according to claim 1, wherein said memory device has a circular cross section and said at least one memory actuator is at least in part removably located annularly on an outer circumference of said memory device.

4. The dispenser according to claim 1, wherein said at least one memory actuator at least in part is constructed as a protective cap for covering at least one of units defined by said at least one discharge actuating means, said at least one memory device and said outlet.

5. The dispenser according to claim 1, further comprising an orienting, rotational preventing plug-in guide for guiding said memory actuation relative to said memory device, and a control servodrive having at least one control cam arranged on said memory actuator and defining a motion path, and at least one counter cam on said at least one memory device in said motion path.

6. The dispenser according to claim 1, wherein said at least one memory device has a ring mounted in rotary manner on a basic body of said dispenser.

7. The dispenser according to claim 1, wherein said at least one memory actuator has cams including at least one of locking cams and actuating cams.

8. The dispenser according to claim 1, wherein at least one operating cam is at least partly located on an inner circumference of said memory actuator.

9. The dispenser according to claim 1, wherein operating cams of said at least one memory device are displaced with respect to each other in at least one of directions defined by a radial direction and an axial actuating direction.

10. The dispenser according to claim 1, wherein with respect to an actuating direction at least one locking cam of said at least one memory device is located radially outside of at least one trailing operating cam.

11. The dispenser according to claim 5, wherein operating cams of said orienting guide engage prior to engagement of said control cams and control countercams during an actuating motion of said at least one memory actuator.

12. The dispenser according to claim 1, further comprising at least one indicator device connected to a basic body of the dispenser controllable by said at least one memory actuator.

13. The dispenser according to claim 12, wherein said at least one indicator device has at least one indicating scale movable with respect to an indicating window provided on at least one of members defined by a basic body of said dispenser and said at least one memory device.

14. The dispenser according to claim 1, wherein at least one operationally movable memory member of said at least one memory device is positionally secured to a basic body of the dispenser by at least one of a snap connection and an operationally self-releasing locking device.

15. The dispenser according to claim 14, wherein on an inner circumference of said at least one memory member is provided an axial retaining torus and a resiliently releasable rotation prevention serration.

16. The dispenser according to claim 1, wherein said at least one memory device is provided on a subassembly separate from at least one discharging unit including a discharge pump and said discharge actuating means.

17. The dispense according to claim 16, wherein said subassembly is mounted substantially separately from said at least one discharging unit on a basic body separable from said discharging unit.

18. The dispenser according to claim 16, wherein said subassembly is mounted on the vessel by at least one of mounting connections defined by at least one snap connection and at least one frictional connection, said subassembly being mounted on a vessel circumference forming a vessel neck on the vessel.

19. The dispenser according to claim 1, wherein a case is provided for insertingly receiving said vessel and discharge actuating means as a separate assembly.

20. The dispenser according to claim 1, wherein a case is provided for entirely but operationally exposeably receiving said dispenser said case being formed by only two separately interengaging caps.

21. The dispenser according to claim 19, wherein said at least one memory device is comprised at least partly by said case.

22. The dispenser according to claim 1, wherein said discharge actuating means has an operating handle which in at least one position engages an inner circumference of a basic body of said at least one memory device.

* * * * *